United States Patent [19]

Avelli et al.

[11] Patent Number: 4,842,008

[45] Date of Patent: Jun. 27, 1989

[54] FIRE HYDRANT

[76] Inventors: Philip Avelli, c/o George Spector, 233 Broadway Rm 3815; George Spector, 233 Broadway Rm 3815, both of New York, N.Y. 10007

[21] Appl. No.: 161,778

[22] Filed: Feb. 29, 1988

[51] Int. Cl.[4] ..... E03B 9/02

[52] U.S. Cl. ..... 137/307; 251/98

[58] Field of Search ..... 137/272, 294, 302, 304, 137/305, 307, 308, 298; 251/96

[56] References Cited

U.S. PATENT DOCUMENTS

| | | | |
|---|---|---|---|
| 2,171,078 | 8/1939 | Cline | 137/272 X |
| 3,070,115 | 12/1962 | Jester | 137/298 X |
| 3,104,554 | 9/1963 | Mueller | 137/307 |
| 3,506,027 | 4/1970 | Dunton | 137/307 |
| 4,549,716 | 10/1985 | Warren | 251/96 |

*Primary Examiner*—Alan Cohan

[57] ABSTRACT

A hydrant water control system is provided which includes a clutch assembly operated by a control wrench which will eliminate the vandalizing of the hydrant and loss of water pressure by illegal opening of the hydrant. A swing away coupling assembly eliminates cost of replacing a broken solid cast iron coupling presently in use on the main valve rod located between the hydrant barrel and bury.

6 Claims, 2 Drawing Sheets

FIRE HYDRANT

BACKGROUND OF THE INVENTION

The instant invention relates generally to water source valve devices and more specifically it relates to a fire hydrant.

Numerous water source valve devices have been provided in prior art that are adapted to operate and direct the flow of water through pipes. For example U.S. Pat. Nos. 2,765,806; 3,070,115; 3,752,179 and 3,926,207 all are illustrative of such prior art. While these units may be suitable for the particular purpose to which they address, they would not be as suitable for the purposes of the present invention as heretofore described.

SUMMARY OF THE INVENTION

A primary object of the present invention is to provide a fire hydrant that will over come the short-comings of the prior art devices.

Another object is to provide a fire hydrant that includes clutch assembly and control wrench which will eliminate the vandalizing of the hydrant and the loss of water pressure in water mains by illegal opening of the hydrant.

An additional object is to provide a fire hydrant that includes a swing away coupling assembly that will elimnate cost of replacing broken main valve rod and hydrant barrel.

A further object is to provide a fire hydrant that is simple and easy to use.

A still further object is to provide a fire hydrant that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
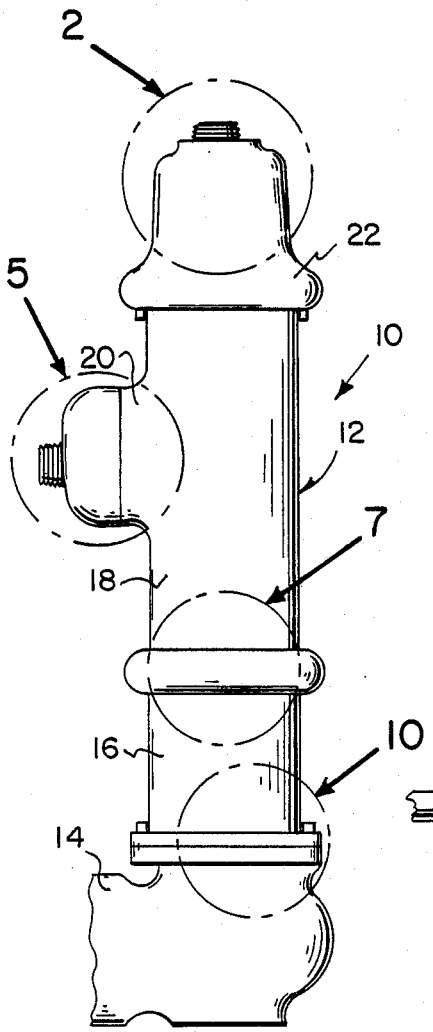
FIG. 1 is an elevation view of a hydrant with the invention.

Turning now descriptively to the drawings, in which similar reference characters denote similar elements throughout the several views, FIGS. 1 through 10 illustrate a water control system 10 for a hydrant 12 of the type having an elbow 14, a bury 16, a barrel 18 with hose nozzle 20, a bonnet 22, an operating yoke stem nut 24 and a segmented main valve rod 26. The system 10 consists of a clutch assembly 28 within the bonnet 22 of the hydrant 12 manipulated by a special wrench 30 to operate the operating yoke stem nut 24 turning the segmented main valve rod 26. A swing away coupling assembly 32 is on the main valve rod 26 within and between the bury 16 and the barrel 18 to prevent the main valve rod 26 from becoming damaged when the barrel 18 is removed form the bury 18. A main valve and drip valve assembly 34 is within and between the elbow 14 and the bury 16 operated by turning of the segmented main valve rod 26.

The clutch assembly 28 contains a compression spring 36 to sit upon the operating yoke stem nut 24 which has an exterior hexagonal surface. A clutch member 38 has a tapered hex recess 40 and a hex formed on exterior 42. The clutch member 38 is suspended over the operating yoke stem nut 24 by the compression spring 36. An operating member 44 has an interior hex 46 shape and a ridgeneck 48 whereby the operating member 44 is placed over the compression spring 36 and clutch member 38 with the ridged neck 48 extending up through the bonnet 22 of the hydrant 12.

The swing away coupling assembly 32 contains a pair of expanding spider rings 50, each having one split on outer ring with drilled and tapered hole in the split. A pair of bolts 52 are provided, each received in one hole in one of the spider rings 50 for expansion so that one of the spider rings 50 can be secured in the bury 16 and other of the spider rings 50 can be secured inthe barrel 18 to hold and guide the segmented main valve rod 26. An inner right hand turn spring 54 is placed over the segmented main valve rod 26 with each end affixed at 56 to the segmented main valve rod 26 betweeen the spider rings 50. An outer left hand turn spring 58 is placed over the inner spring 54 with each end affixed at 60 to the segmented main valve 26 between the spider rings 50. The bury 16 has a top flange 62 with an interior bevel 64 formed on corner thereof while the barrel 18 has a bottom engagement flange 66 with an exterior bevel 68 formed on bottom edge thereof so that the barrel 18 can be tipped over with respect to the bury 16 without damaging the segmented main valve rod 26.

The main valve and drip valve assembly 34 contains a main valve plate operating nut 70 that has an internally threaded hole 72 therein so as to be threadably operated by threaded lower end 74 of the segmented main valve rod 26. The main valve plate operating nut 70 has a guide track 76 to travel up and down to close and open the main valve 78. A perforated spring biased open drip valve 80 is adjacent the main vlave 78. A cross bar 82 is affixed between shank 84 of the main valve plate operating nut 70 and the drip valve 80 so that when the main valve 78 moves downward to the open position the valve head of drip valve 80 will close the perforations (FIG. 10) and when the main valve 78 closes said valve head of the drip valve will move upward by spring pressure to clear the perforations allowing by-pass dripping to occur.

The water control system 10 further contains a hose nozzle cap mechanism 82 within the hose nozzle 20 of the barrel 18 of the hydrant 12 and is manipulated by the special wrench 30 to quickly release the hose nozzle cap mechanism 82. The hose nozzle cap mechanism consists of a hose hook up nozzle 84 within the hose nozzle 20 of the barrel 18 and a hose nozzle cap 86. A sleeve 88 that has a ridged neck 90 is affixed by pins 92 to interior of the hose nozzle cap 86 with the ridged neck 90 extending out through the hose nozzle cap 86. A circular block 94 that has a plurality of radial slots 96 therein is affixed by pins 98 to rear of the sleeve 88. A plurality of angled swivel locking arms 100 are each pivoted at 102 within one of the slots 96 in the block 94. A spring biased release rod 104 extends through the block 94 and into the ridged neck 90 of the sleeve 88. A support block 106 is affixed to end of the release rod 104 adjacent the swivel locking arms 100 and a single coil compression spring 108 extends between the end of the release rod 104 and the swivel locking arms 100.

The special wrench 30 consists of a clamp 110 with internal grooves and an elongated handle 112 which fits tangentially both the ridged neck 48 of the operating member 44 and the ridged neck 90 of the sleeve 88 of the hose nozzle cap mechanism 82. An elongated handle member 114 is hinged at 116 to the clamp 110. A pin 118 is transversely mounted within the handle member 114 so that when the handle member is swung over the clamp 110 the pin 118 will depress the clutch member 38 of the clutch assembly 28 and the release rod 104 of the hose nozzle cap mechanism 82 when the elongated handle member 114 is pressed down. The internal grooves of clamp 110 cooperate with the ridges onboth 48 and 90 for enhanced gripping thereof.

Figure 2:
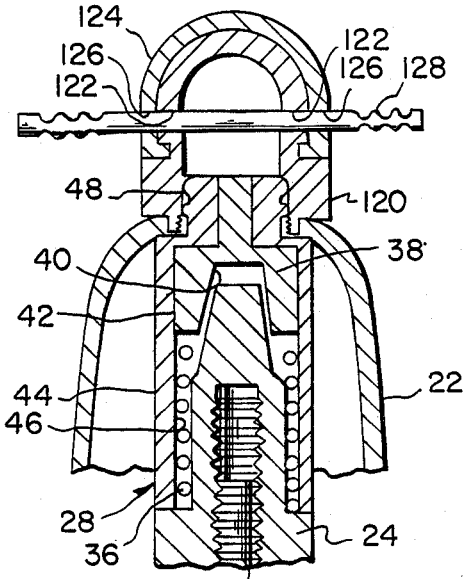
FIG. 2 is an enlarged cross sectional view of the clutch assembly as indicated by numeral 2 in FIG. 1 incorporating a protective cap mechanism.
Figure 3:
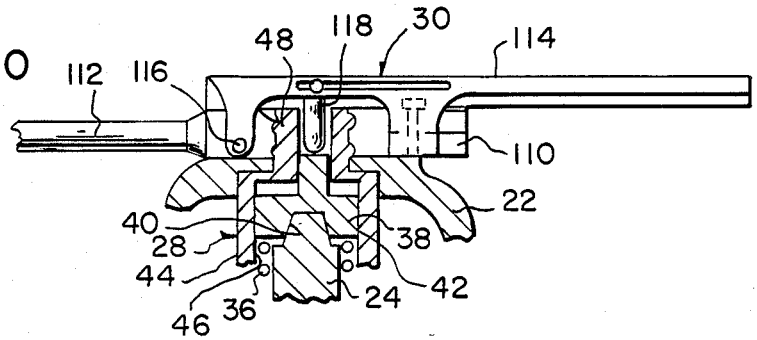
FIG. 3 is a partial cross sectional view with parts broken away showing a water control wrench applied to the clutch assembly.
Figure 4:
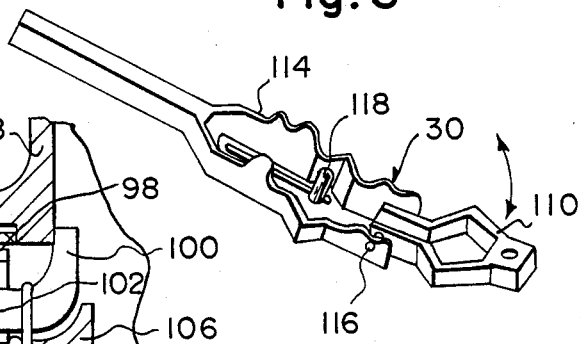
FIG. 4 is a perspective view of the wrench with parts broken away.
Figure 5:
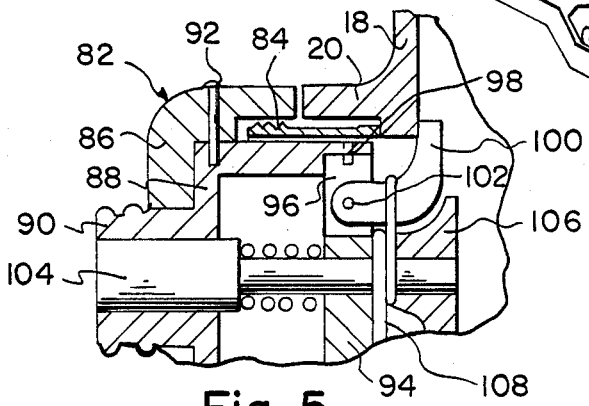
FIG. 5 is an enlarged cross sectional view of the hose nozzle cap mechanism as indicated by numeral 5 in FIG. 1 with parts broken away.
Figure 6:
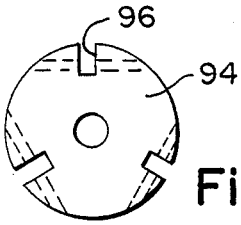
FIG. 6 is a front view of the slotted block in FIG. 5.
Figure 7:
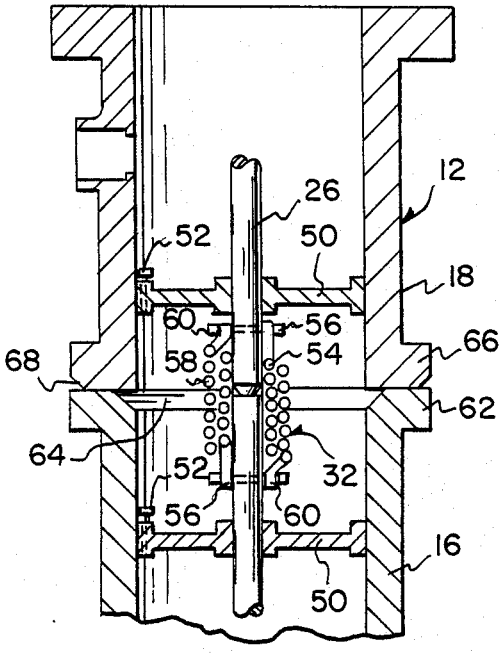
FIG. 7 is an enlarged cross sectional view of the swing away coupling assembly as indicated by numeral 7 in FIG. 1 with parts broken away.
Figure 8:
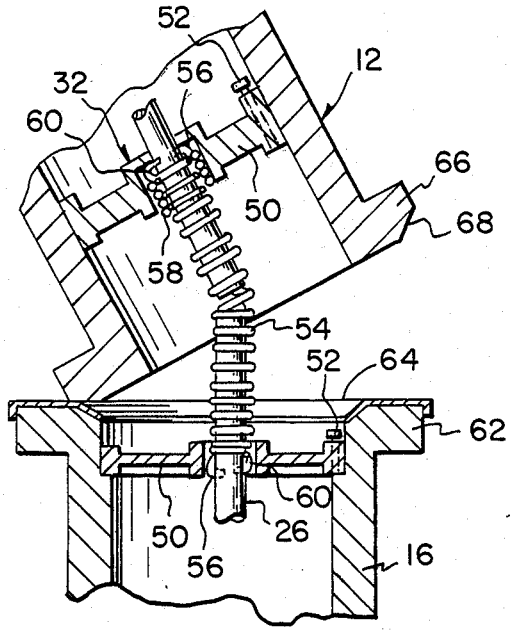
FIG. 8 is an enlarged cross sectional view similar to FIG. 7 showing the hydrant barrel tipped over the hydrant bury with parts broken away.
Figure 9:
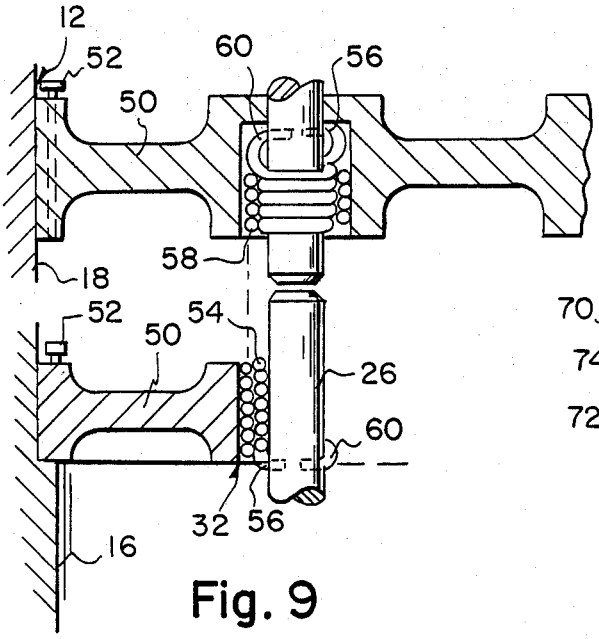
FIG. 9 is an enlarged cross sectional view similar to FIG. 7 with parts broken away.
Figure 10:
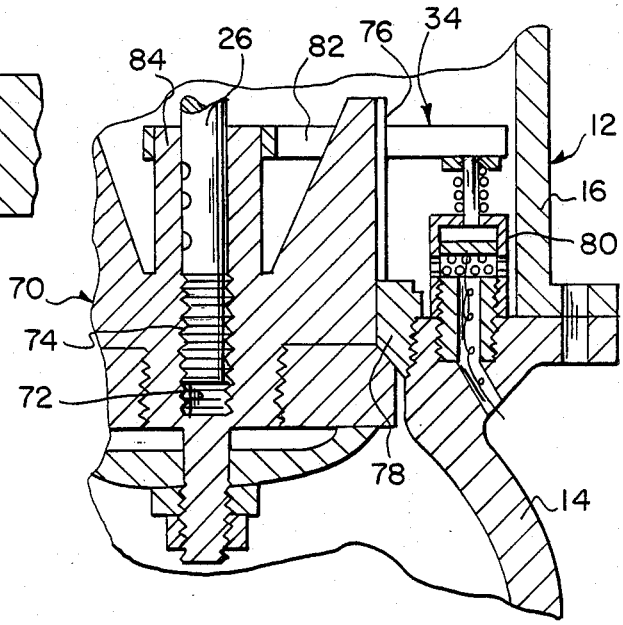
FIG. 10 is an enlarged cross sectional view of the main valve and drip valve assembly as indicated by numeral 10 in FIG. 1 with parts broken away.

As shown in FIG. 2, a protective cap 120 is threaded into the bonnet 22 to protect the clutch assembly 28 from vandalism. The protective cap 120 has a smooth bore tanget to ridged neck 48 and ta pair of diametrically placed holes 122 therethrough. A dome 124 is rotatably affixed to the protective cap 120. The dome 124 has a pair of diametrically placed holes 126 therethrough. A turn bar 128 is placed through the holes 126 in the dome 124 and the holes 122 in the protective cap 120 when the holes 122 and 126 are in alignment with each other so that the protective cap 124 can be removed therefrom.

While certain novel features of this invention have been shown and described and are pointed out in the annexed claims, it will be understood that various omissions, substitutions and changes in the forms and details of the device illustrated and in its operation cna be made by those skilled in the art without departing from the spririt of the invention.

What is claimed is:

1. In a water control system for a hydrant of the type having an elbow, a bury, a barrel with a lateral hose nozzle, a removeable bonnet, an operating yoke stem hex nut and a main valve rod threaded to said nut in combination with a clutch for operating said nut with a wrench, whererin said cluth comprises:

(a) a compression spring mounted on said nut;

(b) a clutch member having a tapered hex recess and a hex shaped exterior, said clutch member suspended over said nut by said spring; and (c) an operating member with a neck and a hex shaped interior engaging said clutch member exterior, said operating member surrounds said compression spring and clutch member and wherein said clutch member is longitudinally moveable to engage said hex nut and wherein said wrench includes means for having said clutch member engage said nut when mounted on said neck.

2. A water control system as recited in claim 1, wherein said valve rod is segmented, in further combination with a swing away coupling assembly comprising:

(a) a pair of expanding spider rings, each having one split on outer ring with drilled and tapered hole in the split;

(b) a pair of bolts, each recieved in one hole in one of said spider rings for expansion so that one of said spider rings can be secured in the bury and other of said spider rings can be secured in the bonnet to hold and guide the segmented main valve rod;

(c) a pair of springs, one being an inner right hand turn spring placed over the segmented main valve rod, said inner spring having each end affixed to the segmented main valve rod between said spider rings; while other being an outer left hand turn spring placed over the inner spring, said outer spring having each end affixed to the segmented main valve rod between said spider rings; and (d) the bury having two flange with an interior bevel formed on corner thereof while the barrel can be tipped over with respect to the bury without damaging the segmented main valve rod.

3. A water control system as recited in claim 2, in combination with a main valve and drip valve assembly comprising:

(a) a main valve plate operating nut having an internally threaded hole therein so as to be threadably operated by threaded lower end of the segmented main valve rod, said main valve plate operating nut having a guide track to travel up and down to close and open the main valve;

(b) a perforated spring biased open drip valve adjacent the main valve; and (c) means coacting between said main valve plate operating nut and said drip valve so that when the main valve opens said drip valve will close and when the main valve closes said drip valve will open due to said drip valve being spring biased open.

4. A water control system as recited in claim 1, further comprising a lateral hose nozzle cap mechanism within said hose nozzle operated by said wrench to quickly release the hose nozzle cap mechanism, comprising:

(a) a hose hook up nozzle within said lateral hose nozzle of the barrel;

(b) a lateral hose nozzle cap;

(c) a sleeve having a laterial neck, said sleeve affixed to interior of said hose nozzle cap with said neck extending out through the hole nozzle cap;

(d) a circular block having a pluraltiy of radial slots therein said block affixed to rear of said sleeve;

(e) a plurality of angled swivel locking arms, each of which is provided within one of the slots in said block;

(f) a spring biased release rod extending through said block and into said neck;

(g) a support block affixed to end of said release rod adjacent said swivel locking arms; and (h) a compression spring extending between the end of said release rod and said swivel locking arms.

5. A water control system as recited in claim 4, wherein the special wrench comprises:

(a) a clamp with internal ridges adapted to fit the neck of said operating member and the ridged neck of said sleeve of said hose nozzle cap mechanism;

(b) an elongated handle member hinged to said clamp member; and (c) a pin transversely mounted within said handle member so that when said handle is swung over said clamp member said pin will depress said clutch member of said clutch assembly and the release rod of said hose nozzle cap mechanism when said elongated handle member is pressed down.

6. A master control system as recited in claim 1, further comprising:

(a) a protective cap threaded into the bonnet to protect the clutch assembly from vandalism, said protective cap having a pair of diametrically placed holes therethrough;

(b) a dome rotatably affixed to said protective cap, said dome having a pair of diametrically placed holes therethrough; and (c) a turn bar to be placed through the holes in said dome and the holes in said protective cap when said holes are in alignment with each other so that said protective cap can be removed therefrom.

* * * * *